US006087945A

United States Patent [19]

Yasuda

[11] Patent Number: 6,087,945

[45] Date of Patent: Jul. 11, 2000

[54] PUMP FAILURE ALARM SYSTEM FOR HYDRAULIC WORKING MACHINE

[75] Inventor: Gen Yasuda, Ibaraki-ken, Japan

[73] Assignee: Hitachi Construction Machinery Co., Ltd., Tokyo, Japan

[21] Appl. No.: 09/227,736

[22] Filed: Jan. 8, 1999

[30] Foreign Application Priority Data

Jan. 8, 1998 [JP] Japan ..... 10-002579

[51] Int. Cl.[7] ..... G08B 21/00

[52] U.S. Cl. ..... 340/611; 340/626; 340/629; 340/685; 37/348; 37/902; 73/121; 73/168; 74/731.1; 74/732.1; 116/168

[58] Field of Search ..... 340/611, 614, 340/626, 679, 685; 73/168, 121, 40; 74/731.1, 732.1; 37/348, 902; 701/50; 116/168

[56] References Cited

U.S. PATENT DOCUMENTS 4,558,593 12/1985 Watanabe et al. ..... 73/168
5,631,632 5/1997 Nakashima et al. ..... 340/611
5,822,891 10/1998 Fujishima et al. ..... 37/348
5,823,072 10/1998 Legner ..... 74/733.1
5,887,365 3/1999 Fujishima et al. ..... 37/348

FOREIGN PATENT DOCUMENTS 4-29816 5/1992 Japan .

*Primary Examiner*—Daniel J. Wu
*Attorney, Agent, or Firm*—Beall Law Offices

[57] ABSTRACT

A pump failure alarm system which is provided in a hydraulic working machine comprising hydraulic pumps driven by a prime mover, delivery lines joining with one another into one common delivery line on the downstream side, check valves provided in the delivery lines upstream of a point where the delivery lines join with one another, a hydraulic cylinder driven by a hydraulic fluid introduced through the common delivery line, and a hydraulic reservoir. The pump failure alarm system comprises pressure sensors for detecting respective delivery pressures of the hydraulic pumps, bypass lines having one ends connected to the delivery lines at points upstream of the check valves and the other ends connected to the hydraulic reservoir, solenoid switching valves for opening and closing the associated bypass lines, an alarm display unit for giving an alarm in correspondence to each of the hydraulic pumps, and a controller.

6 Claims, 9 Drawing Sheets

PUMP FAILURE ALARM SYSTEM FOR HYDRAULIC WORKING MACHINE

BACKGROUND OF THE INVENTION

1. Field of the Invention

The present invention relates to a large-sized hydraulic working machine in which a plurality of hydraulic pumps are connected in parallel and employed as one large hydraulic pump equivalently, and more particularly to a pump failure alarm system for a hydraulic working machine which determines whether the individual hydraulic pumps are good or not, and gives an alarm to an operator in the event of a pump failure.

2. Description of the Prior Art

In hydraulic working machines such as hydraulic excavators, one or more hydraulic pumps are driven by one or more prime movers and one or more hydraulic actuators are driven by hydraulic fluids delivered from the hydraulic pumps. When installed in a hydraulic working machine, a hydraulic pump having the size and capacity in match with a working ability of the hydraulic working machine is selected. It is however general in a large-sized hydraulic working machine that a plurality of hydraulic pumps are connected in parallel and employed as one large hydraulic pump equivalently from the viewpoints of cost and reliability. In that case, the number of hydraulic pumps to be installed in a hydraulic working machine is determined depending on a maximum flow rate demanded by hydraulic actuators of the hydraulic working machine.

JP, B, 4-29816 discloses a hydraulic excavator as one example of the known art relating to such a large-sized hydraulic working machine. Four hydraulic pumps driven by two engines are disposed in a hydraulic circuit of the disclosed hydraulic excavator. Of the first to fourth hydraulic pumps, the first and second ones are driven by a first engine, while the third and fourth ones are driven by a second engine. Delivery circuits of the first and third hydraulic pumps are joined with each other and led to a first group of control valves, and delivery circuits of the second and fourth hydraulic pumps are joined with each other and led to a second group of control valves. A hydraulic fluid is thereby supplied to a hydraulic actuator associated with each corresponding group of control valves.

SUMMARY OF THE INVENTION

In hydraulic working machines such as hydraulic excavators, as described above, required work is carried out by driving hydraulic actuators by a hydraulic fluid delivered from a hydraulic pump installed in the hydraulic working machine. Accordingly, if any trouble occurs in the hydraulic pump, the work to be carried out by the hydraulic working machine is impeded considerably. It is therefore important to quickly take a maintenance action such as replacement of parts for keeping an adverse effect upon the work at minimum and avoiding a reduction in the availability factor of the hydraulic working machine if any trouble occurs in the hydraulic pump during the work. Also, if any fragments of a broken hydraulic pump are entrained into a delivery circuit, the fragments may possibly flow up to the downstream side of the delivery circuit, thus resulting in damage of an entire hydraulic system and increased cost of overhaul. Therefore, a quick maintenance action is also important for the purpose of avoiding those serious drawbacks.

In the case where a hydraulic working machine is, for example, not so large that all hydraulic actuators are connected to a delivery circuit of only one hydraulic pump, it is possible for the operator to recognize the occurrence of a trouble of the hydraulic pump from change in operating speed of any of the hydraulic actuators. However, the following problem occurs in a large-sized hydraulic working machine wherein a plurality of hydraulic pumps are connected in parallel and employed as one large hydraulic pump equivalently like the above-mentioned hydraulic excavator disclosed in JP, B, 4-29816. If any trouble has occurred in one of the two hydraulic pumps whose delivery circuits are joined with each other, the operator can recognize the occurrence of a trouble from change in operating speed of the associated hydraulic actuator, but it is very difficult for the operator to determine which one of the hydraulic pumps has failed.

The present invention has been made in view of the above-described problem experienced in the prior art, and its object is to provide a pump failure alarm system for a hydraulic working machine including a plurality of hydraulic pumps whose delivery circuits are joined with one another so that the hydraulic pumps are employed as one large hydraulic pump equivalently, the alarm system being able to reliably specify the failed hydraulic pump, to prevent an adverse effect of the failure from spreading to an entire hydraulic circuit, and to give an alarm to the operator.

To achieve the above object, according to the present invention, there is provided a pump failure alarm system provided in a hydraulic working machine comprising a plurality of hydraulic pumps driven by at least one prime mover, a plurality of delivery lines introducing respective flows of a hydraulic fluid delivered from the plurality of hydraulic pumps and joining with one another into one common line on the downstream side, a plurality of check valves provided respectively in the plurality of delivery lines upstream of a point where the plurality of delivery lines join with one another, at least one hydraulic actuator driven by the hydraulic fluid introduced through the common line, and a hydraulic reservoir, wherein the pump failure alarm system comprises a plurality of pressure detecting means for detecting respective delivery pressures of the plurality of hydraulic pumps, a plurality of bypass lines having one ends connected respectively to the plurality of delivery lines at points upstream of the check valves and the other ends connected to the hydraulic reservoir, a plurality of opening/closing means disposed respectively in the plurality of bypass lines for opening and closing the associated bypass lines, alarm means for giving an alarm to an operator in correspondence to each of the plurality of hydraulic pumps, and control means for controlling the opening/closing operations of the opening/closing means and the alarming operation of the alarm means in accordance with the results detected by the pressure detecting means.

When any failure has occurred in only one of the plurality of hydraulic pumps and the other pumps remain normal, the delivery pressure of only the one failed pump is lowered while the delivery pressures of the other pumps are not lowered. This condition is detected by the pressure detecting means. In response to the detection, the control means makes such control, for example, that only the opening/closing means in the bypass line, whose one end is connected to the delivery line of the one hydraulic pump, is opened to make that bypass line open thoroughly. At this time, since the other end of that bypass line is connected to the hydraulic reservoir, the pressure in that bypass line becomes almost equal to the reservoir pressure. Therefore, nearly all of the hydraulic fluid from the one hydraulic pump flows into that bypass line and is then introduced to the hydraulic reservoir without being introduced to the common line on the downstream side. On the other hand, since the opening/closing means in the bypass lines, whose one ends are connected to the delivery lines of the other normal hydraulic pumps, are held closed, the hydraulic fluid from the other hydraulic pumps is all introduced to the common line on the downstream side and is then supplied to the hydraulic actuator.

As a result, the hydraulic fluid from the one failed hydraulic pump can be isolated from the hydraulic fluid from the other hydraulic pumps so that only the hydraulic fluid from the other hydraulic pumps is introduced to the hydraulic actuator through the common line. It is therefore possible to avoid an adverse effect of the pump failure from spreading to an entire hydraulic circuit, which may be possibly caused by, for example, any fragments of the failed hydraulic pump if they should intrude into the common line and the hydraulic actuator. Simultaneously, the control means controls the alarm means, for example, to give an alarm in correspondence to the one hydraulic pump. The operator can therefore surely recognize and specify that the one hydraulic pump has failed.

In the above pump failure alarm system for the hydraulic working machine, preferably, the control means comprises first determining means for determining whether the delivery pressure of one of the plurality of hydraulic pumps is lower than the delivery pressures of the other hydraulic pumps by a predetermined value or more, opening/closing control means for opening the opening/closing means in the bypass line connected to the delivery line of the one hydraulic pump and closing the other opening/closing means in a first case where the determination made by the first determining means is satisfied, and for closing all the opening/closing means in a second case where the determination made by the first determining means is not satisfied, and alarm control means for causing the alarm means to give an alarm in correspondence to the one hydraulic pump in the first case, and not causing the alarm means to give any alarm in the second case.

Also, in the above pump failure alarm system for the hydraulic working machine, preferably, the alarm means includes a plurality of display means for indicating alarms separately in correspondence to the hydraulic pumps, and the alarm control means causes the display means for the one hydraulic pump to indicate an alarm in the first case.

Further, in the above pump failure alarm system for the hydraulic working machine, preferably, the plurality of hydraulic pumps are variable displacement pumps whose displacements are controlled respectively by a plurality of pump control means, and the control means includes flow rate limit control means for controlling the pump control means associated with the one hydraulic pump and limiting a delivery rate of the one hydraulic pump in the first case.

With the above feature, the flow rate of the hydraulic fluid introduced from the one hydraulic pump to the hydraulic reservoir through the associated bypass line and opening/closing means being open can be minimized in the first case. The capacities of the bypass lines and the opening/closing means can be therefore set to relatively small values in the design stage. As a result, the costs of the bypass lines and the opening/closing means can be reduced.

Preferably, the above pump failure alarm system for the hydraulic working machine further comprises drive detecting means for detecting whether the hydraulic pumps are driven, wherein the control means comprises second determining means for determining whether at least two of the plurality of hydraulic pumps are driven, and when the determination made by the second determining means is not satisfied, the opening/closing control means closes all the opening/closing means regardless of the results detected by the pressure detecting means and the alarm control means does not cause the alarm means to give any alarm to the operator regardless of the results detected by the pressure detecting means.

With this feature, the opening/closing means and the alarm means can be avoided from malfunctioning in the case of two or more hydraulic pumps being not driven, i.e., in the case where the basic requisite for detecting a pump failure is not held.

Preferably, the above pump failure alarm system for the hydraulic working machine further comprises drive detecting means for detecting whether the hydraulic pumps are driven, wherein when at least one of the hydraulic pumps is determined to be not driven in accordance with the result detected by the drive detecting means, the control means excludes the opening/closing means and the alarm means, which are associated with the hydraulic pump not being driven, from objects to be controlled.

With this feature, supposing the case that in a hydraulic working machine including three hydraulic pumps, for example, one hydraulic pump is not driven for maintenance or some other reason, it is possible to avoid such a malfunction that the opening/closing means associated with the one hydraulic pump being not driven is opened, or the alarm means starts giving an alarm by mistake.

DETAILED DESCRIPTION OF THE PREFERRED EMBODIMENTS

Preferred embodiments of the present invention will be described hereunder with reference to the drawings.

A first embodiment of the present invention will be described with reference to FIGS. 1 to 4.

Figure 1:
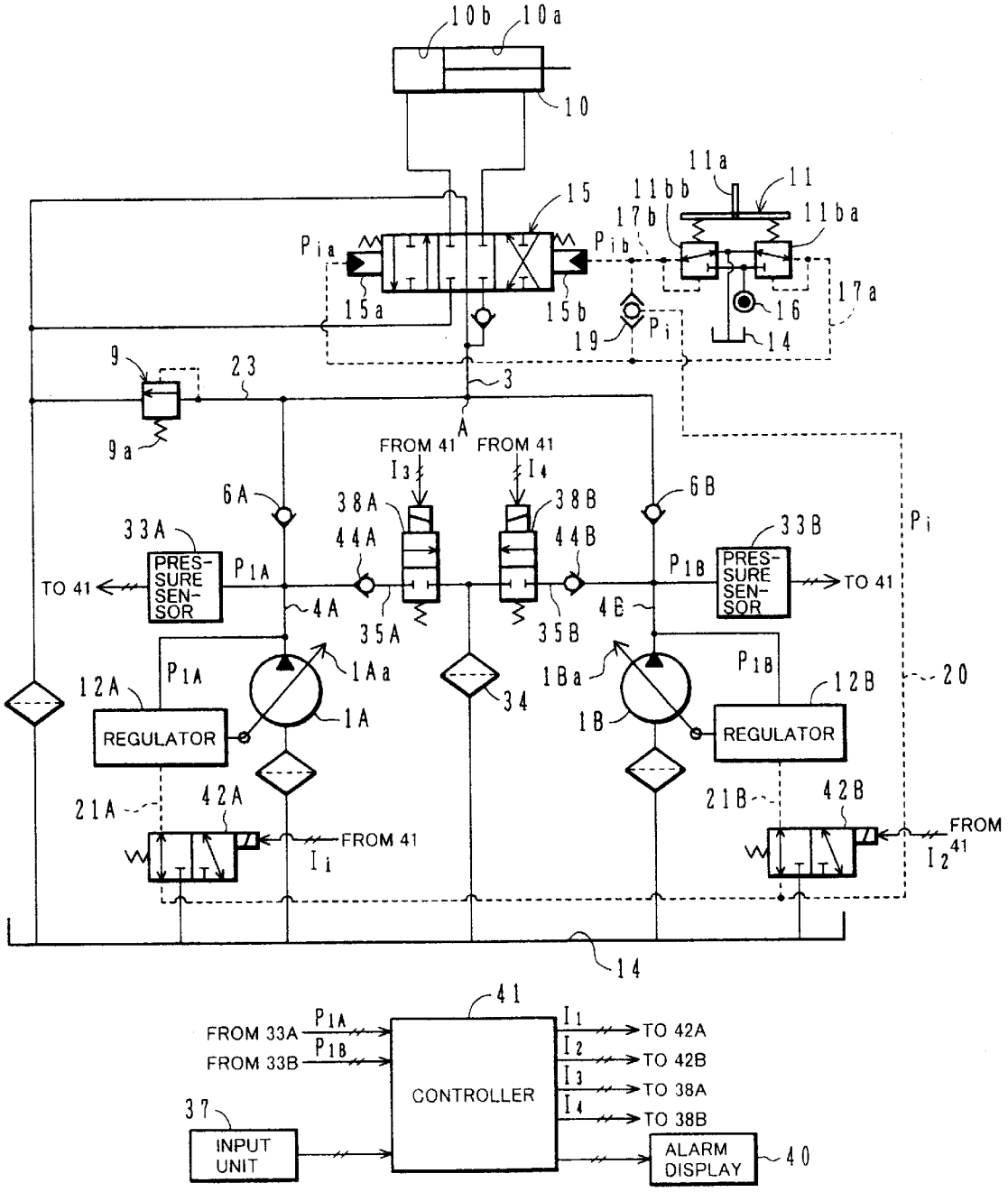
FIG. 1 is a hydraulic circuit diagram of a hydraulic drive system in which a pump failure alarm system according to a first embodiment of the present invention is employed.

FIG. 1 is a hydraulic circuit diagram of a hydraulic drive system in which a pump failure alarm system according to this embodiment is employed.

In FIG. 1, the hydraulic drive system is installed in hydraulic working machines such as hydraulic excavators.

The hydraulic drive system comprises a plurality of variable displacement hydraulic pumps driven by one not-shown prime mover (e.g., engine), for example, first and second hydraulic pumps 1A, 1B provided respectively with swash plates 1A*a*, 1B*a*; delivery lines 4A, 4B allowing a hydraulic fluid delivered from first and second hydraulic pumps 1A, 1B to flow therethrough and joining with each other on the downstream side to provide one common delivery line 3; check valves 6A, 6B disposed respectively in the delivery lines 4A, 4B upstream of a junction point A therebetween; a relief valve 9 for determining a maximum pressure in the delivery lines 4A, 4B; at least one hydraulic actuator, e.g., a hydraulic cylinder 10, driven by the hydraulic fluid delivered from the first and second hydraulic pumps 1A, 1B and introduced through the common delivery line 3; a control lever unit 11 for operating the hydraulic cylinder 10; pump control means, e.g., regulators 12A, 12B, for controlling displacements of the first and second hydraulic pumps 1A, 1B (tilting angles of the swash plates 1A*a*, 1B*a*), respectively; and a hydraulic reservoir 14.

The hydraulic cylinder 10 is a cylinder for rotating a front member (such as a boom, an arm or a bucket) as one component of a work front of a hydraulic excavator (not shown), for example. When the hydraulic fluid is supplied to the hydraulic cylinder 10 from the first and second hydraulic pumps 1A, 1B through the common delivery line 3, the flow rate and flow direction of the hydraulic fluid are controlled by a control valve 15.

The control lever unit 11 comprises a control lever 11*a* and pressure reducing valves 11*ba*, 11*bb*. When the control lever 11*a* is operated to one side, a pilot pressure supplied from a hydraulic source 16 comprising a pilot pump, for example, is reduced by the pressure reducing valve 11*ba* (or 11*bb*) in accordance with an input amount by which the control lever 11*a* is operated. A resulting pilot pressure Pia (or Pib) is introduced to a driving sector 15*a* (15*b*) of the control valve 15 through a pilot line 17*a* (or 17*b*), whereupon the control valve 15 is shifted. Upon the shift of the control valve 15, the hydraulic fluid is supplied to a rod side 10*a* (or a bottom side 10*b*) of the hydraulic cylinder 10, causing the front member to rotate correspondingly.

The maximum of the pilot pressures Pia, Pib is selected by a shuttle valve 19 and then introduced, as a maximum pilot pressure Pi, to the regulators 12A, 12B through a line 20 and lines 21A, 21B branched from the line 20.

The relief valve 9 includes a spring 9*a*, and is disposed in a line 23 branched from the delivery line 4A and leading to the hydraulic reservoir 14. When delivery pressures P1A, P1B of the first and second hydraulic pumps 1A, 1B reach a relief pressure Pr set by the resilient force of the spring 9*a*, the relief valve 9 is operated to return the hydraulic fluid from the first and second hydraulic pumps 1A, 1B to the hydraulic reservoir 14.

The regulators 12A, 12B control the tilting angles of the swash plates 1A*a*, 1B*a* respectively in accordance with the delivery pressures P1A, P1B of the first and second hydraulic pumps 1A, 1B and the maximum pilot pressure Pi introduced through the lines 21A, 21B. A detailed structure of the regulator 12A or 12B is shown in FIG. 2.

Figure 2:
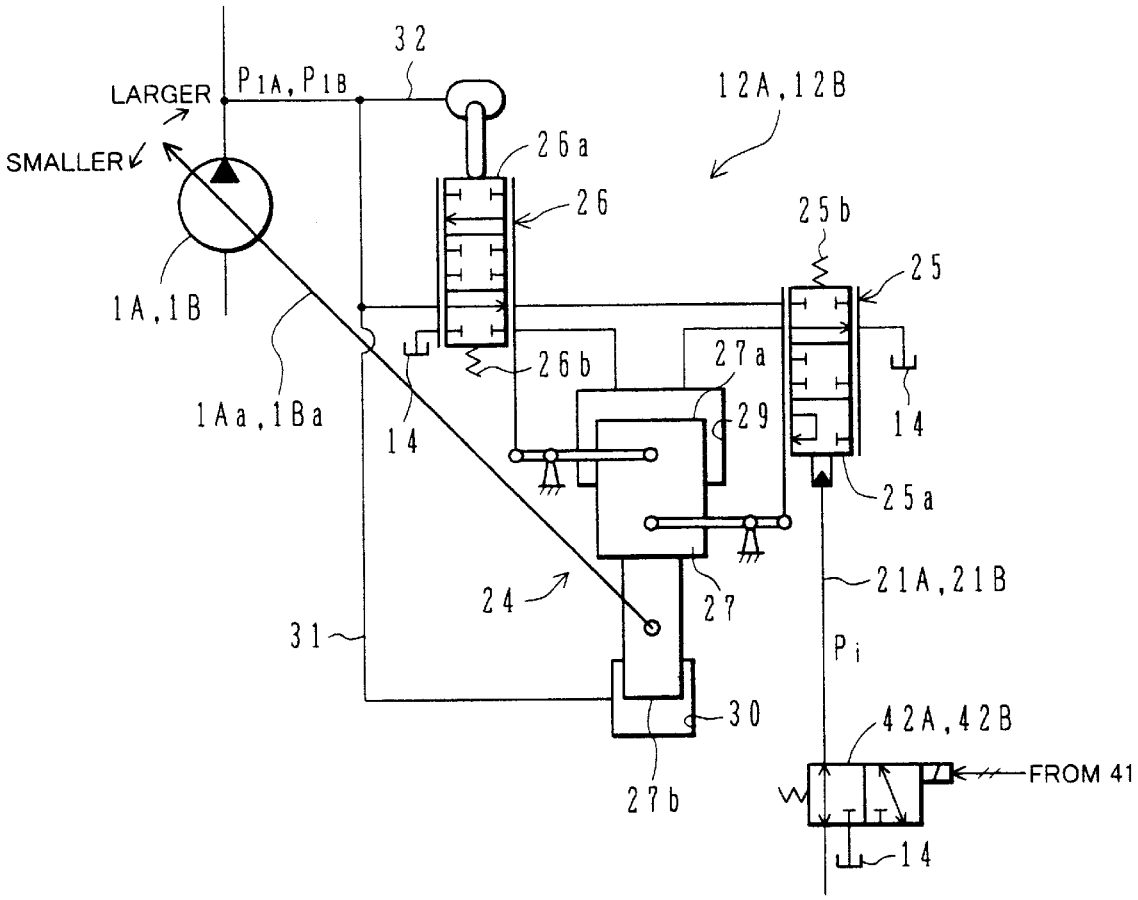
FIG. 2 is a diagram showing a detailed structure of a regulator shown in FIG. 1.

More specifically, in FIG. 2, the regulator 12A or 12B comprises a tilting actuator 24, a first servo valve 25 which is operated in accordance with the input amount from the control lever 11*a* of the control lever unit 11 for ordinary tilting control, and a second servo valve 26 for input torque limiting control. These servo valves 25, 26 serve to control a pressure of the hydraulic fluid acting upon the tilting actuator 24 from the first or second hydraulic pump 1A, 1B, thereby controlling the tilting angle (i.e., the displacement) of the swash plate 1A*a* or 1B*a* of the first or second hydraulic pump 1A, 1B.

The tilting actuator 24 comprises a differential piston 27 having a large-diameter end portion 27*a* and a small-diameter end portion 27*b* formed at opposite ends thereof, and piston chambers 29, 30 in which the end portions 27*a*, 27*b* are positioned, respectively. When pressures in both the piston chambers 29, 30 are equal to each other, the differential piston 27 is moved downward in FIG. 2 due to a difference in pressure receiving area between the end portions 27*a*, 27*b*, whereupon the tilting angle of the swash plate 1A*a* or 1B*a* is enlarged and the pump delivery rate is increased. Also, when the pressure in the piston chamber 29 on the large diameter side lowers, the differential piston 27 is moved upward in FIG. 2, whereupon the tilting angle of the swash plate 1A*a* or 1B*a* is diminished and the pump delivery rate is decreased.

The first servo valve 25 for ordinary tilting control is a valve operated in accordance with the maximum pilot pressure Pi introduced from the line 21A or 21B. More specifically, when the maximum pilot pressure Pi is high, a valve body 25*a* is moved upward in FIG. 2, whereupon the delivery pressure P1A, P1B introduced from the first or second hydraulic pump 1A, 1B through the second servo valve 26 is transmitted to the piston chamber 29 of the tilting actuator 24 without being reduced. At this time, the delivery pressure P1A, P1B is also introduced from the first or second hydraulic pump 1A, 1B to the piston chamber 30 through a line 31, but the differential piston 27 is moved downward in FIG. 2 due to the above-mentioned difference in pressure receiving area.

Accordingly, the tilting angle of the swash plate 1A*a* or 1B*a* is enlarged and the delivery rate of the first or second hydraulic pump 1A, 1B is increased. Then, as the maximum pilot pressure Pi lowers, the valve body 25*a* is moved downward in FIG. 2 under an action of the resilient force of a spring 25*b*, whereupon the delivery pressure P1A, P1B from the first or second hydraulic pump 1A, 1B is cut off and simultaneously the hydraulic fluid in the piston chamber 29 is introduced to the hydraulic reservoir 14 so that the pressure in the piston chamber 29 lowers. Accordingly, the differential piston 27 is moved upward in FIG. 2 to reduce the delivery rate of the first or second hydraulic pump 1A, 1B.

The second servo valve 26 for input torque limiting control is a valve operated in accordance with the delivery pressure P1A, P1B introduced from the first or second hydraulic pump 1A, 1B through a line 32. More specifically, when the delivery pressure P1A, P1B of the first or second hydraulic pump 1A, 1B is lower than a set value of the resilient force of a spring 26*b*, a valve body 26*a* is moved upward in FIG. 2, whereupon the delivery pressure P1A, P1B from the first or second hydraulic pump 1A, 1B is transmitted to the first servo valve 25 without being reduced. Accordingly, the tilting angle of the swash plate 1A*a* or 1B*a* of the first or second hydraulic pump 1A, 1B is enlarged and the pump delivery rate is increased.

Then, as the delivery pressure P1A, P1B of the first or second hydraulic pump 1A, 1B rises above the set value of the resilient force of the spring 26*b*, the valve body 26*a* is moved downward in FIG. 2, whereupon the delivery pressure P1A, P1B from the first or second hydraulic pump 1A, 1B is cut off and simultaneously the hydraulic fluid in the piston chamber 29 is introduced to the hydraulic reservoir 14 so that the pressure in the piston chamber 29 lowers. Accordingly, the differential piston 27 is moved upward in FIG. 2 to reduce the delivery rate of the first or second hydraulic pump 1A, 1B.

As a result of the above operation of each regulator, the tilting angles of the swash plates 1A*a*, 1B*a* of the first and second hydraulic pumps 1A, 1B are controlled such that as the input amount from the control lever unit 11 increases, the delivery rates of the first and second hydraulic pumps 1A, 1B are increased to provide the pump delivery rates in match with flow rated demanded by the control valve 15 (the so-called positive control), and in addition the tilting angles of the swash plates 1A*a*, 1B*a* of the first and second hydraulic pumps 1A, 1B are controlled such that as the delivery pressures P1A, P1B of the first and second hydraulic pumps 1A, 1B rise, maximum values of the delivery rates of the first and second hydraulic pumps 1A, 1B are limited to become smaller to keep loads of the first and second hydraulic pumps 1A, 1B from exceeding an output torque of the prime mover (not shown) (the so-called input torque limiting control).

The pump failure alarm system according to this embodiment is installed in the hydraulic drive system constructed as described above.

The pump failure alarm system comprises pressure detecting means, e.g., pressure sensors 33A, 33B, for detecting respectively the delivery pressures P1A, P1B of the first and second hydraulic pumps 1A, 1B; bypass lines 35A, 35B having one ends connected respectively to the delivery lines 4A, 4B at points upstream of the check valves 6A, 6B and the other ends connected to the hydraulic reservoir 14 through a filter 34; opening/closing means, e.g., solenoid switching valves 38A, 38B, disposed respectively in the bypass lines 35A, 35B for opening and closing the bypass lines 35A, 35B; check valves 44A, 44B disposed respectively in the bypass lines 35A, 35B at points upstream of the solenoid switching valves 38A, 38B; alarm means, e.g., an alarm display unit 40, for giving an alarm to the operator in correspondence to each of the first and second hydraulic pumps 1A, 1B; solenoid switching valves 42A, 42B disposed respectively in the lines 21A, 21B, through which the maximum pilot pressure Pi is introduced to the regulators 12A, 12B, for opening and closing the lines 21A, 21B; a revolution speed sensor (not shown) for detecting a revolution speed of the prime mover; control means, e.g., a controller 41 comprising a computer, for controlling the shift (opening/closing) operations of the solenoid switching valves 38A, 38B, 42A, 42B and the alarming operation of the alarm display unit 40 in accordance with the results detected by the pressure sensors 33A, 33B and the revolution speed sensor; and an input unit 37 through which an instruction for clearing the alarm is inputted.

Though not shown in particular, the alarm display unit 40 includes two display portions in which alarms are separately indicated in correspondence to the first and second hydraulic pumps 1A, 1B, allowing the operator to recognize which one of the pumps is alarmed when the alarm is indicated.

Detailed functions of the controller 41 will now be described with reference to a flowchart shown in FIG. 3.

Figure 3:
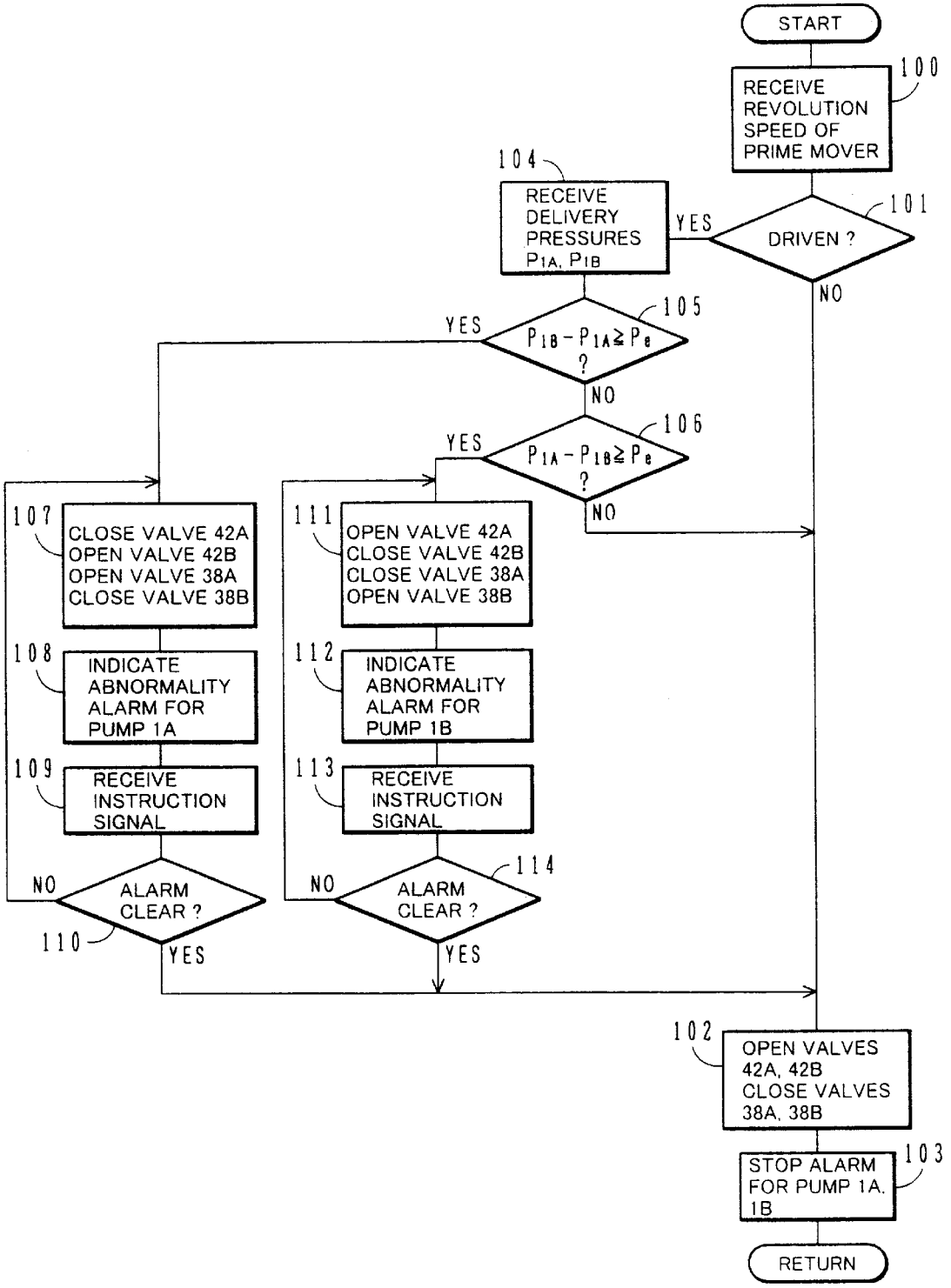
FIG. 3 is a flowchart showing detailed functions of a controller shown in FIG. 1.

Referring to FIG. 3, in step 100, the controller first receives a signal from the revolution speed sensor for detecting a revolution speed of the prime mover. The process flow then goes to step 101 where the controller determines whether the first and second hydraulic pumps 1A, 1B are driven, i.e., whether the engine is rotated, in accordance with the signal received in step 100. Instead of receiving the revolution speed of the prime mover, whether the first and second hydraulic pumps 1A, 1B are driven may also be determined by receiving detection signals from the pressure sensors 33A, 33B for detecting the delivery pressures P1A, P1B of the first and second hydraulic pumps 1A, 1B in step 100 similarly to later-described step 104, and determining in step 101 whether the detected delivery pressures P1A, P1B are not lower than a predetermined threshold value. As an alternative, whether the first and second hydraulic pumps 1A, 1B are driven may be determined by providing, in the delivery lines 4A, 4B, flowmeters for detecting delivery rates of the first and second hydraulic pumps 1A, 1B, receiving signals detected by the flowmeters in step 100, and determining in step 101 whether the detected delivery rates are not lower than a predetermined threshold value.

If it is determined in step 101 that the first and second hydraulic pumps 1A, 1B are not driven, the process flow goes to step 102 where driving signals I1, I2 applied to the solenoid switching valves 42A, 42B are turned off. The solenoid switching valves 42A, 42B are thereby shifted to open positions (left-hand positions in FIG. 1) so that the regulators 12A, 12B perform the ordinary tilting control. At the same time, driving signals I3, I4 applied to the solenoid switching valves 38A, 38B are turned off for shifting them to closed positions (lower positions in FIG. 1), thereby cutting off the bypass lines 35A, 35B. After that, in step 103, the controller outputs a control signal for stopping any alarm to the alarm display unit 40, followed by returning to the start.

On the other hand, if it is determined in step 101 that the first and second hydraulic pumps 1A, 1B are driven, the process flow goes to step 104 where the controller receives detection signals from the pressure sensors 33A, 33B for detecting the delivery pressures P1A, P1B of the first and second hydraulic pumps 1A, 1B.

Then, in step 105 and step 106, the controller 41 determines in accordance with the delivery pressures P1A, P1B of the first and second hydraulic pumps 1A, 1B, which were received in step 104, whether differences P1B−P1A and P1A−P1B between the delivery pressures P1A, P1B is not less than a predetermined value Pe which is set and stored in the controller 41 beforehand.

Note that the predetermined value Pe is set to a value much larger than the pressure difference that corresponds to a line loss inevitably occurred in the normal condition. If P1B−P1A<Pe and P1A−P1B<Pe hold, the determinations in steps 105 and 106 are both not satisfied, and therefore the process flow goes to step 102.

If P1B−P1A≧Pe is satisfied in step 105, the controller determines that any failure has occurred in the first hydraulic pump 1A, followed by going to step 107.

In step 107, the driving signal I1 applied to the solenoid switching valve 42A is turned on for shifting it to a closed position (right-hand position in FIG. 1). The maximum pilot pressure Pi acting upon the first servo valve 25 of the regulator 12A is thereby cut off to move the valve body 25*b* to the upper position in FIG. 2 so that the tilting angle of the swash plate 1A*a* of the first hydraulic pump 1A is minimized.

The driving signal I2 applied to the solenoid switching valve 42B associated with the second hydraulic pump 1B is kept turned off, causing the tilting angle of the swash plate 1B*a* to be controlled by the regulator 12B under the ordinary tilting control.

Also, in step 107, the driving signal I3 applied to the solenoid switching valve 38A is turned on for shifting it to an open position (upper position in FIG. 1). The bypass line 35A is thereby made open thoroughly so that the hydraulic fluid from the first hydraulic pump 1A is introduced to the hydraulic reservoir 14 through the filter 34.

The driving signal I4 applied to the solenoid switching valve 38B associated with the second hydraulic pump 1B is kept turned off, and the bypass line 35B is maintained in a cutoff state.

Subsequently, the process flow goes to step 108 where the controller indicates an alarm in the display portion of the alarm display unit 40 in correspondence to the first hydraulic pump 1A, whereby the operator is alarmed for the fact that a failure has occurred in the first hydraulic pump 1A, followed by going to step 109.

In step 109, the controller receives an instruction signal from the input unit 37. The process flow then goes to step 110 where the controller determines whether the operator has instructed clear of the alarm. If the alarm clear instruction is not yet inputted, the controller returns to step 107 to repeat the processing described above. If the alarm clear instruction is inputted by the operator, the controller goes to step 102 for setting the hydraulic system to return to the normal condition where the solenoid switching valves 42A, 42B are opened and the solenoid switching valves 38A, 38B are closed. Thus, the regulators 12A, 12B perform the ordinary tilting control while the bypass lines 35A, 35B are held cut off.

On the other hand, if $P1A-P1B \geqq Pe$ is satisfied in step 106, the controller determines that any failure has occurred in the second hydraulic pump 1B, followed by going to step 111.

In step 111, the driving signal I2 applied to the solenoid switching valve 42B is turned on for shifting it to a closed position (right-hand position in FIG. 1) so that the tilting angle of the swash plate 1B*a* of the second hydraulic pump 1B is minimized. The driving signal I1 applied to the solenoid switching valve 42A associated with the first hydraulic pump 1A is kept turned off, causing the tilting angle of the swash plate 1A*a* to be controlled by the regulator 12A under the ordinary tilting control. Also, the driving signal I4 applied to the solenoid switching valve 38B is turned on for shifting it to an open position (upper position in FIG. 1). The bypass line 35B is thereby made open thoroughly so that the hydraulic fluid from the second hydraulic pump 1B is introduced to the hydraulic reservoir 14.

The driving signal I3 applied to the solenoid switching valve 38A associated with the first hydraulic pump 1A is kept turned off, and the bypass line 35A is maintained in a cutoff state.

Subsequently, the process flow goes to step 112 where the controller indicates an alarm in the display portion of the alarm display unit 40 in correspondence to the second hydraulic pump 1B, whereby the operator is alarmed for the fact that a failure has occurred in the second hydraulic pump 1B.

In step 113, the controller receives an instruction signal from the input unit 37. The process flow then goes to step 114 where the controller determines whether the operator has instructed clear of the alarm. If the alarm clear instruction is not yet inputted, the controller returns to step 111 to repeat the processing described above. If the alarm clear instruction is inputted by the operator, the controller goes to step 102 for setting the hydraulic system to return to the normal condition where the solenoid switching valves 42A, 42B are opened and the solenoid switching valves 38A, 38B are closed. Thus, the regulators 12A, 12B perform the ordinary tilting control while the bypass lines 35A, 35B are held cut off.

In the construction described above, the revolution speed sensor (not shown) for detecting a revolution speed of the prime mover constitutes drive detecting means for detecting whether the hydraulic pumps are driven. However, in the above-described modification where it is determined in step 101 whether the delivery pressures P1A, P1B detected by the pressure sensors 33A, 33B are not lower than a predetermined threshold value, the pressure sensors 33A, 33B constitute the drive detecting means. In the alternative modification where it is determined in step 101 whether the delivery rates detected by flowmeters are not lower than a predetermined threshold value, the flowmeters constitute the drive detecting means. Also, the step 101 executed by the controller 41 constitutes second determining means for determining in accordance with the result detected by the drive detecting means whether at least two of a plurality of hydraulic pumps are driven.

Further, the steps 105 and 106 constitute first determining means for determining whether the delivery pressure of one of the plurality of hydraulic pumps is lower than the delivery pressure of another hydraulic pump by a predetermined value or more, and Pe provides the predetermined value. The steps 107, 111 and 102 constitute opening/closing control means for opening the opening/closing means in a bypass line connected to a delivery line of the one hydraulic pump and closing the opening/closing means in bypass lines connected to delivery lines of the other hydraulic pumps in a first case where the determination made by the first determining means is satisfied, and for closing all the opening/closing means in a second case where the determination made by the first determining means is not satisfied.

The steps 108, 112 and 103 constitute alarm control means for causing the alarm means to give an alarm in correspondence to the one hydraulic pump in the first case, and not causing the alarm means to give any alarm in the second case. The steps 107 and 111 also constitute flow rate limit control means for controlling the associated pump control means and limiting the delivery rate of the one hydraulic pump in the first case.

In the alarm display unit 40, the two display portions for indicating alarms in correspondence to the first hydraulic pump 1A and the second hydraulic pump 1B, respectively, constitute a plurality of display means for indicating respective alarms in correspondence to the hydraulic pumps separately.

Additionally, the case, in which the controller goes to step 102 directly to execute the processing of steps 102 and 103 when the determination in step 101 is not satisfied, corresponds to that if the determination made by the second determining means is not satisfied, the opening/closing control means closes all the opening/closing means regardless of the results detected by the pressure detecting means, and the alarm control means instructs the alarm means to give no alarms regardless of the results detected by the pressure detecting means.

Also, in the case where the controller goes to step 102 directly to execute the processing of steps 102 and 103 when the determination in step 101 is not satisfied, the solenoid switching valves 42A, 42B are opened and the solenoid switching valves 38A, 38B are closed in step 102. This corresponds to that those solenoid switching valves are not subjected to control and are left to stand in a natural state, because the solenoid switching valves are respectively opened and closed under an action of the restoring forces of the springs disposed therein with the driving signals kept turned off. Further, the processing of step 103, in which alarms for the first and second hydraulic pumps 1A, 1B are stopped, corresponds to that the alarm display unit 40 is not subjected to control and is left to stand in a natural state, because the alarm display unit 40 is normally or naturally in a state of giving no alarms.

Accordingly, the case, in which the controller goes to step 102 directly to execute the processing of steps 102 and 103 when the determination in step 101 is not satisfied, further corresponds to that if at least one hydraulic pump is determined to be not driven in accordance with the result detected by the drive detecting means (pumps which are determined to be not driven are always two in the illustrated embodiment, but the above-described modifications of step 100 are adaptable for the case of one pump being determined to be not driven; hence the number of pumps determined to be not driven may possibly be one), the opening/closing means and the alarm means associated with the hydraulic pump, which has been determined to be not driven, are excluded from the objects to be controlled.

The operation and advantages of this embodiment having the above construction will be described below.

When the operator intends to carry out some work by using a hydraulic excavator, the prime mover is started to rotate for driving the first and second hydraulic pumps 1A, 1B, and the control lever unit 11 is operated. The control valve 15 is shifted from a neutral position to the right or left in response to the pilot pressure Pia, Pib generated upon the control lever unit 11 being operated. The hydraulic fluid from the first and second hydraulic pumps 1A, 1B is then supplied to the hydraulic cylinder 10 for driving it. At this time, the controller 41 receives the pump delivery pressures P1A, P1B from the pressure sensors 33A, 33B in step 104 subsequent to the processing of steps 100 and 101 shown in FIG. 3.

When the first and second hydraulic pumps 1A, 1B are both normal, there is not a large difference between the delivery pressures P1A and P1B. Therefore, the process flow goes, through steps 105 and 106, to step 102 where the solenoid switching valves 42A, 42B are both held open. The maximum pressure Pi of the pilot pressures Pia and Pib generated upon the operation of the control lever unit 11 is introduced to the respective first servo valves 25 of the regulators 12A, 12B. Responsively, the first servo valves 25 are shifted so that the swash plates 1A*a*, 1B*a* of the first and second hydraulic pumps 1A, 1B are set to target tilting angles in match with the input amount by which the control lever 11*a* is operated.

At the same time, the delivery pressures P1A, P1B of the first and second hydraulic pumps 1A, 1B are also introduced to the respective second servo valves 26 of the regulators 12A, 12B for the input torque limiting control. Responsively, the second servo valves 26 are shifted so that the swash plates 1A*a*, 1B*a* are set to target tilting angles at which the total pump sucking torque of the first and second hydraulic pumps 1A, 1B is kept not larger than the output torque of the prime mover.

As a result, the smaller of the target tilting angles in the input torque limiting control and the target tilting angles in the ordinary tilting control is selected and set as final target tilting angles. The swash plates 1A*a*, 1B*a* of the first and second hydraulic pumps 1A, 1B are then regulated to have the final target tilting angles.

Further, in this case, since the solenoid switching valves 38A, 38B are held in the closed positions in step 102, the hydraulic fluid delivered from the first and second hydraulic pumps 1A, 1B is all supplied to the hydraulic cylinder 10 for driving it without being introduced to the hydraulic reservoir 14 through the bypass lines 35A, 35B.

Supposing now, for example, that any failure has occurred in one of the first and second hydraulic pumps 1A, 1B while the second hydraulic pump 1B is normal, the delivery pressure P1A of only the first hydraulic pump 1A is much lowered, and the delivery pressure P1B of the second hydraulic pump 1B is not lowered. Resulting values of the delivery pressures P1A, P1B are then detected by the pressure sensors 33A, 33B.

In this case, since the determination in step 105 is satisfied subsequent to the processing of steps 100, 101 and 104, the process flow goes to step 107 where the controller 41 shifts the solenoid switching valve 38A in the bypass line 35A, which is connected to the delivery line 4A of the first hydraulic pump 1A, to the open position so that the bypass line 35A becomes open thoroughly. This lowers the pressure in the bypass line 35A down to a level almost equal to the reservoir pressure because the bypass line 35A is connected to the hydraulic reservoir 14. Nearly all of the hydraulic fluid from the first hydraulic pump 1A flows into the bypass line 35A and is introduced to the hydraulic reservoir 14 without being introduced to the common delivery line 3 on the downstream side.

On the other hand, in step 107, the solenoid switching valve 38B in the bypass line 35B, which is connected to the delivery line 4B of the normal second hydraulic pump 1B, is held in the closed position. The hydraulic fluid from the second hydraulic pump 1B is therefore all introduced to the common delivery line 3 on the downstream side and is then supplied to the hydraulic cylinder 10. Thus, the hydraulic fluid from the failed first hydraulic pump 1A can be isolated from the hydraulic fluid from the normal second hydraulic pump 1B so that only the hydraulic fluid from the second hydraulic pump 1B is introduced to the hydraulic cylinder 10 through the common delivery line 3. Consequently, it is possible to avoid an adverse effect of the pump failure from spreading to the entire hydraulic circuit, which may be possibly caused by, for example, any fragments of the failed first hydraulic pump 1A if they should intrude into the common delivery line 3 and the hydraulic cylinder 10.

Also, since the load imposed on the failed first hydraulic pump 1A is reduced down to substantially nil, the failure of the first hydraulic pump 1A itself can be avoided from being aggravated and becoming more serious. Another merit is that it is easy to check the cause of the failure because the first hydraulic pump 1A can be held in a condition relatively close to an initial stage of the failure.

Further, in step 107, the solenoid switching valve 42A for introducing the maximum pilot pressure Pi, which acts on the regulator 12A, is shifted to the closed position to minimize the delivery rate of the first hydraulic pump 1A. As a result, the flow rate of the hydraulic fluid introduced from the first hydraulic pump 1A to the hydraulic reservoir 14 through the bypass line 35A and the solenoid switching valve 38A can be minimized.

Subsequently, in step 108, the controller 41 gives an alarm for the first hydraulic pump 1A in the alarm display unit 40, enabling the operator to surely recognize and specify that the first hydraulic pump 1A has failed. Therefore, the operator can immediately stop the prime mover and take a maintenance action such as replacement of parts of the first hydraulic pump 1A.

When the maintenance action is completed and the failure of the first hydraulic pump 1A is fixed, the operator enters an alarm clear instruction through the input unit 37. Since the determination in step 110 is now satisfied, the process flow goes to step 102 where the controller 41 returns the solenoid switching valve 42A to the open position and the solenoid switching valve 38A to the closed position. Then, the alarm indicated in the alarm display unit 40 is stopped in step 103, causing the hydraulic system to be returned to the normal condition.

In the event that any failure has occurred in only the second hydraulic pump 1B, as another example, the control process is executed in a similar manner as described above. More specifically, a reduction in the delivery pressure P1B of the second hydraulic pump 1B is detected by the pressure sensor 33B. Responding to the detection, in step 111, the controller 41 shifts the solenoid switching valve 38B in the bypass line 35B to the open position, but holds the solenoid switching valve 38A in the bypass line 35A to the closed position, whereby nearly all of the hydraulic fluid from the second hydraulic pump 1B is introduced to the hydraulic reservoir 14, while the hydraulic fluid from the first hydraulic pump 1A is all supplied to the hydraulic cylinder 10 through to the common delivery line 3. At the same time, the solenoid switching valve 42B is shifted to the closed position to minimize the delivery rate of the second hydraulic pump 1B so that the flow rate of the hydraulic fluid introduced to the hydraulic reservoir 14 through the bypass line 35B and the solenoid switching valve 38B is minimized.

Subsequently, in step 112, the controller 41 gives an alarm for the second hydraulic pump 1B in the alarm display unit 40. In response to the alarm, the operator can immediately take a maintenance action such as replacement of parts of the second hydraulic pump 1B. When the failure of the second hydraulic pump 1B is fixed and an alarm clear instruction is entered through the input unit 37, the determination in step 114 is satisfied. Therefore, the process flow goes to step 102 where the controller 41 returns the solenoid switching valve 42B to the open position and the solenoid switching valve 38B to the closed position. Then, the alarm indicated in the alarm display unit 40 is stopped in step 103, causing the hydraulic system to be returned to the normal condition.

In the case where the prime mover is stopped for the purpose of, e.g., routine maintenance and the first and second hydraulic pumps 1A, 1B are also stopped although both the pumps 1A, 1B are not failed, the determination made by the controller 41 in step 114 is not satisfied, and therefore the process flow goes to steps 102 and 103. This surely avoids such a malfunction that the solenoid switching valves 38A, 38B; 42A, 42B are shifted to the open positions and the closed positions, respectively, or the alarm display unit 40 starts giving an alarm by mistake.

According to this embodiment, as described above, the hydraulic fluid from one of the first and second hydraulic pumps 1A, 1B, which has failed, can be isolated from the hydraulic fluid from the other normal hydraulic pump so that only the hydraulic fluid from the normal hydraulic pump is introduced to the hydraulic cylinder 10 through the common delivery line 3. It is therefore possible to avoid an adverse effect of the pump failure from spreading to the entire hydraulic circuit, which may be possibly caused by, for example, any fragments of the failed hydraulic pump if they should intrude into the common delivery line 3 and the hydraulic cylinder 10.

Also, in the event of the pump failure, since the alarm display unit 40 indicates an alarm in correspondence to the failed hydraulic pump, the operator can surely recognize and specify the failed hydraulic pump and can immediately take a maintenance action such as replacement of parts of the failed hydraulic pump. Consequently, suspension of the work to be performed by using a hydraulic excavator is minimized, and a reduction in the availability factor of the hydraulic excavator can be avoided.

Further, in the event of the pump failure, since the delivery rate of one hydraulic pump which has failed is minimized, the flow rate of the hydraulic fluid introduced from the failed hydraulic pump to the hydraulic reservoir 14 through the bypass line 35A or 35B and the solenoid switching valve 38A or 38B, which are associated with the failed hydraulic pump, can be minimized. As a result, the capacities of the bypass lines 35A, 35B, the solenoid switching valves 38A, 38B, etc. can be set to relatively small values in the design stage; hence the costs of these parts can be reduced.

While, in the above first embodiment, the first and second hydraulic pumps 1A, 1B have been described as variable displacement pumps which are subjected to the ordinary tilting control and input torque limiting control both effected by the regulators 12A, 12B, the present invention is not limited to the use of variable displacement pumps, and the hydraulic pumps may be fixed displacement pumps. In this case, since the regulators 12A, 12B are omitted, the above-mentioned advantage of reducing the cost of parts, which is resulted from minimizing the delivery rate of the failed hydraulic pump, cannot be obtained. With the provision of the bypass lines 35A, 35B, the solenoid switching valves 38A, 38B, the alarm display unit 40 and so on, however, it is possible to achieve the basic advantages of the present invention that an adverse effect of the failure can be prevented from spreading and the operator can specify which hydraulic pump has failed.

Also, while, in the above first embodiment, the pressure value Pe is set and stored in the controller 41 beforehand, the present invention is not limited to such a manner of setting the pressure value Pe, and separate input means may be provided so that the operator can enter the pressure value Pe before starting the work each time the work is started. In this case, similar advantages to those in the above-mentioned first embodiment can also be obtained.

Further, while the above first embodiment has been described in connection with, by way of example, the case where the present invention is applied to a hydraulic working machine including the two first and second hydraulic pumps 1A, 1B driven by a single prime mover, the present invention is not limited to such an application, but is also applicable to a hydraulic working machine including three or more hydraulic pumps driven by two or more prime movers. This modification will be described with reference to FIG. 4. In the following description, portions related to equivalent members to those in FIGS. 1 and 2 are denoted by the same reference numerals.

Though not shown in particular, a hydraulic drive system employed in this modification comprises, basically similarly to the hydraulic drive system employed in the first embodiment, three or more variable displacement hydraulic pumps 1A, 1B, 1C, etc. (referred to simply as "hydraulic pump(s) 1" hereinafter; this is equally applied to other member) driven by two or more prime movers (e.g., engines); three or more delivery lines 4 joining with one another on the downstream side to provide one common delivery line 3; check valves 6 disposed respectively in the delivery lines 4 upstream of a junction point thereof; a hydraulic cylinder 10 driven by the hydraulic fluid delivered from the hydraulic pumps; a control lever unit 11 for operating the hydraulic cylinder 10; regulators 12 for controlling displacements of the hydraulic pumps 1 (tilting angles of their swash plates 1*a*), respectively; and a hydraulic reservoir 14.

A pump failure alarm system according to this modification comprises, basically similarly to the pump failure alarm system according to the first embodiment, pressure sensors 33 for detecting respectively delivery pressures P1A, P1B, P1C, etc. of the hydraulic pumps 1; bypass lines 35 having one ends connected respectively to the delivery lines 4 at points upstream of the check valves 6; solenoid switching valves 38 for opening and closing the bypass lines 35, respectively; an alarm display unit 40 for giving an alarm to the operator in correspondence to each of the hydraulic pumps 1; solenoid switching valves 42 for opening and closing the lines 21 through which a maximum pilot pressure Pi is introduced to the regulators 12; revolution speed sensors for detecting revolution speeds of the prime movers; a controller 41 for controlling the opening/closing operations of the solenoid switching valves 38, 42 and the alarming operation of the alarm display unit 40 in accordance with the results detected by the pressure sensors 33 and the revolution speed sensors; and an input unit 37 through which an instruction for clearing the alarm is inputted.

Figure 4:
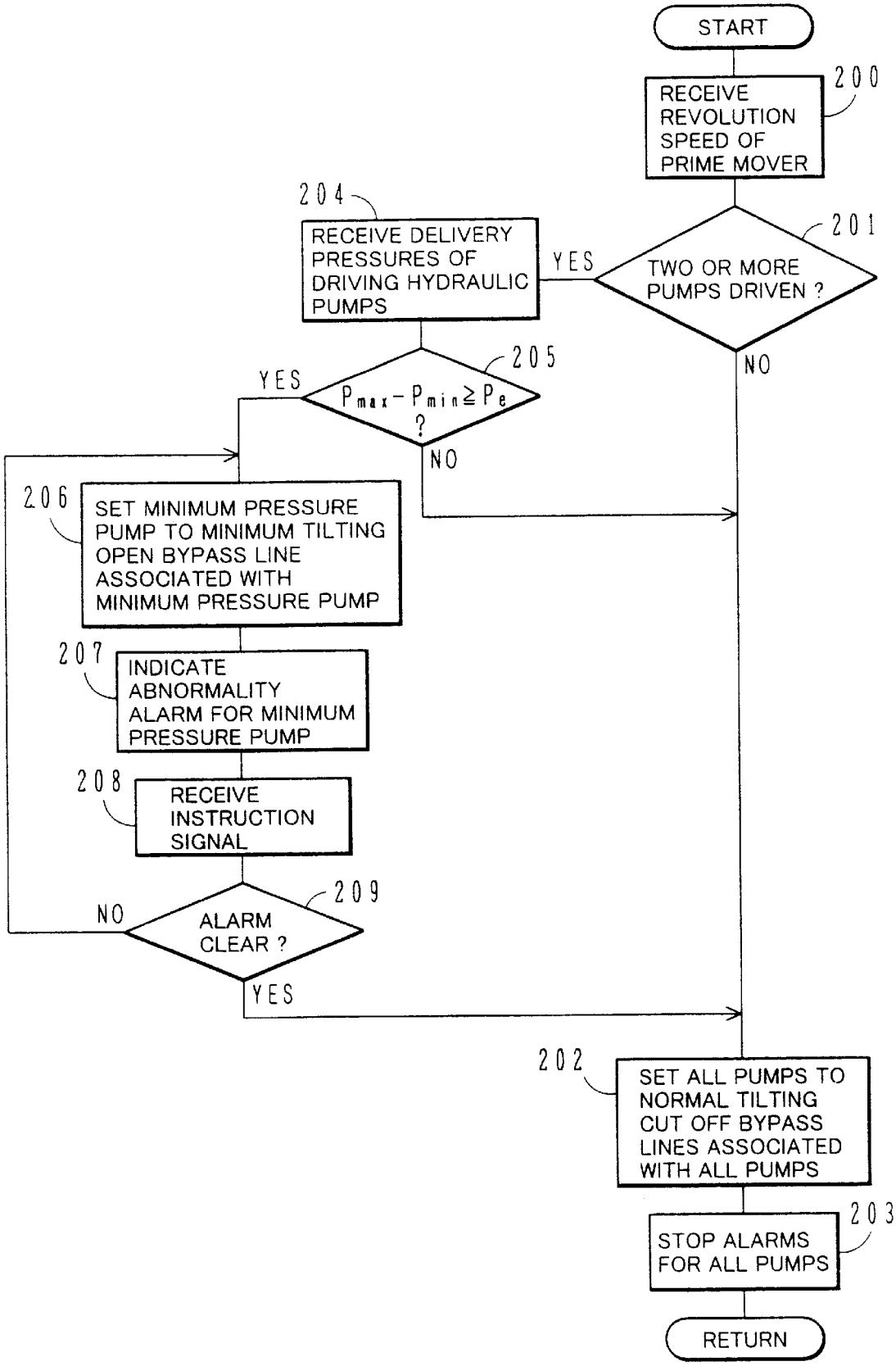
FIG. 4 is a flowchart showing detailed functions of a controller used in a modification.

FIG. 4 is a flowchart showing detailed functions of the controller 41 in this modification, and corresponds to FIG. 3 representing the first embodiment.

Referring to FIG. 4, in step 200, the controller first receives signals from the revolution speed sensors provided respectively on the two or more prime movers. The process flow then goes to step 201 where the controller determines whether two or more of the three hydraulic pumps 1 are driven in accordance with the signals received in step 200.

If it is determined in step 201 that two or more hydraulic pumps 1 are not driven (i.e., when only one hydraulic pump is driven, or when no hydraulic pumps are driven), the process flow goes to step 202 where driving signals applied to the solenoid switching valves 42 associated with all the hydraulic pumps 1 are turned off. The solenoid switching valves 42 are thereby shifted to open positions so that the regulators 12 perform the ordinary tilting control and input torque limiting control. At the same time, driving signals applied to all the solenoid switching valves 38 are turned off for shifting them to closed positions, thereby cutting off the bypass lines 35. After that, in step 203, the controller outputs a control signal for stopping any alarm to the alarm display unit 40, followed by returning to the start.

On the other hand, if it is determined in step 201 that two or more hydraulic pumps 1 are driven, the process flow goes to step 204 where the controller receives, as detection signals from the pressure sensors 33, the delivery pressures P1 of only those ones of all the hydraulic pumps 1 which are driven.

Then, in step 205, the controller 41 determines in accordance with the delivery pressures P1 of the hydraulic pumps 1, which were received in step 204, whether a difference Pmax−Pmin between a maximum value Pmax and a minimum value Pmin of the received delivery pressures P1 is not less than a predetermined value Pe which is set and stored in the controller 41 beforehand. If Pmax−Pmin<Pe holds, the determination in step 205 is not satisfied, and therefore the process flow goes to step 202.

If Pmax−Pmin≧Pe is satisfied in step 205, the controller determines that any failure has occurred in the hydraulic pump 1 whose delivery pressure has the minimum value Pmin (hereinafter also referred to as "minimum pressure hydraulic pump 1"), followed by going to step 206. In step 206, the driving signal applied to the solenoid switching valve 42 associated with the minimum pressure hydraulic pump 1 is turned on for shifting it to a closed position. The maximum pilot pressure Pi acting upon the associated regulator 12 is thereby cut off to minimize the tilting angle of the swash plate of the minimum pressure hydraulic pump 1. Also, in step 206, the driving signal applied to the solenoid switching valve 38 associated with the minimum pressure hydraulic pump 1 is turned on for shifting it to an open position. The associated bypass line 35 is thereby made open thoroughly so that the hydraulic fluid from the minimum pressure hydraulic pump 1 is introduced to the hydraulic reservoir 14.

Subsequently, the process flow goes to step 207 where the controller indicates an alarm in the display portion of the alarm display unit 40 in correspondence to the minimum pressure hydraulic pump 1, whereby the operator is alarmed for the fact that a failure has occurred in the minimum pressure hydraulic pump 1, followed by going to step 208. In step 208, the controller receives an instruction signal from the input unit 37. The process flow then goes to step 209 where the controller determines whether the operator has instructed clear of the alarm. If the alarm clear instruction is not yet inputted, the controller returns to step 206 to repeat the processing described above. If the alarm clear instruction is inputted by the operator, the controller goes to step 202 where the regulator 12 associated with the minimum pressure hydraulic pump 1 is set to perform the ordinary tilting control and input torque limiting control while the associated bypass line 35 is cut off, thus causing the hydraulic system to return to the normal condition.

In the above construction of this modification, the step 201 executed by the controller 41 constitutes second determining means for determining in accordance with the result detected by drive detecting means whether at least two of a plurality of hydraulic pumps are driven. Also, the step 205 constitutes first determining means for determining whether the delivery pressure of one of the plurality of hydraulic pumps is lower than the delivery pressure of another hydraulic pump by a predetermined value or more.

Further, the steps 206 and 202 constitute opening/closing control means for opening the opening/closing means in a bypass line connected to a delivery line of the one hydraulic pump and closing the opening/closing means in bypass lines connected to delivery lines of the other hydraulic pumps in a first case where the determination made by the first determining means is satisfied, and for closing all the opening/closing means in a second case where the determination made by the first determining means is not satisfied. The steps 207 and 203 constitute alarm control means for causing the alarm means to give an alarm in correspondence to the one hydraulic pump in the first case, and not causing the alarm means to give any alarm in the second case. The step 206 also constitutes flow rate limit control means for controlling the associated pump control means and limiting the delivery rate of the one hydraulic pump in the first case.

Additionally, the case, in which the controller goes to step 202 directly to execute the processing of steps 202 and 203 when the determination in step 201 is not satisfied, corresponds to that if the determination made by the second determining means is not satisfied, the opening/closing control means closes all the opening/closing means regardless of the results detected by the pressure detecting means, and the alarm control means instructs the alarm means to give no alarms regardless of the results detected by the pressure detecting means.

Also, the case, in which the controller receives in step 204 the delivery pressures P1 of only those ones of all the hydraulic pumps 1, which are driven, in accordance with the detection signals received in step 200 and then executes various control in subsequent steps 206–209 based on the received delivery pressures, corresponds to that if at least one hydraulic pump is determined to be not driven in accordance with the result detected by the drive detecting means, the opening/closing means and the alarm means associated with the hydraulic pump, which has been determined to be not driven, are excluded from the objects to be controlled.

This modification operates as follows. Supposing, for example, that any failure has occurred in one of all the hydraulic pumps 1, the delivery pressure P1 of only the failed hydraulic pump 1 is much lowered. Lowering of the delivery pressure P1 is detected by the associated pressure sensor 33, and a detection signal is applied to the controller 41. In this case, the determination made the controller 41 in step 205 is satisfied subsequent to the processing of steps 200, 201 and 204. The process flow goes to step 206 where the bypass line 35 connected to the delivery line 4 of the minimum pressure hydraulic pump 1 is made open thoroughly, causing nearly all of the hydraulic fluid from the minimum pressure hydraulic pump 1 to be introduced to the hydraulic reservoir 14. On the other hand, the solenoid switching valves 38 in the bypass lines 35, which are connected to the delivery lines 4 of the other hydraulic pumps 1, are held in the closed positions so that the hydraulic fluid from the other hydraulic pumps 1 is supplied to the hydraulic cylinder 10 through the common delivery line 3 on the downstream side. Thus, the hydraulic fluid from the failed minimum pressure hydraulic pump 1 can be isolated from the hydraulic fluid from the other hydraulic pumps. As with the above first embodiment, therefore, it is possible to avoid an adverse effect of the pump failure from spreading to the entire hydraulic circuit.

Further, in step 206, the solenoid switching valve 42 for introducing the maximum pilot pressure Pi to the regulator 12, which is associated with the minimum pressure hydraulic pump 1, is shifted to the closed position to minimize the delivery rate of the minimum pressure hydraulic pump 1. As a result, the flow rate of the hydraulic fluid introduced from the minimum pressure hydraulic pump 1 to the hydraulic reservoir 14 through the bypass line 35 can be minimized.

Subsequently, in step 207, the controller 41 gives an alarm for the minimum pressure hydraulic pump 1 in the alarm display unit 40, enabling the operator to surely recognize and specify that the minimum pressure hydraulic pump 1 has failed. Therefore, the operator can immediately stop the associated prime mover and take a maintenance action such as replacement of parts of the failed hydraulic pump 1. When the maintenance action is completed, the operator enters an alarm clear instruction through the input unit 37. Since the determination in step 209 is now satisfied, the process flow goes to step 202 where the controller 41 sets the swash plates 1*a* of all the hydraulic pumps 1 to the normal tilting angles and returns the solenoid switching valves 38 associated with all the hydraulic pumps 1 to the closed positions. Then, the alarm indicated in the alarm display unit 40 is stopped in step 203, causing the hydraulic system to be returned to the normal condition.

With the foregoing operation, this modification can also provide similar advantages as obtainable with the above first embodiment.

In this modification, the failed hydraulic pump is found by, in step 205, calculating the difference between the maximum value Pmax and the minimum value Pmin of all the delivery pressures P1 of the hydraulic pumps 1 under driving, and determining that the hydraulic pump 1 providing the minimum value Pmin has failed, when the calculated difference is not less than the predetermined value Pe. However, the method of determining the failed hydraulic pump is not limited to the illustrated one, but may be implemented in any other suitable way. For example, it is possible to take a mean value Pmean of the all delivery pressures P1 of the hydraulic pumps 1 under driving, to calculate deviations Pmean−P1 between the respective pump delivery pressures P1 and the mean value Pmean, and to determine that the hydraulic pump providing the largest deviation has failed. Alternatively, in the case where the displacements of the hydraulic pumps 1 differ from each other, the failed hydraulic pump may be found by taking, as a difference, the hydraulic pump 1 having the maximum displacement, and determining that the hydraulic pump providing the largest deviation from the delivery pressure of the reference pump has failed.

A second embodiment of the present invention will be described with reference to FIGS. 5 to 9. In this second embodiment, the present invention is applied to a hydraulic drive system in which pump control is performed by regulators electrically rather than hydraulically in the above first embodiment.

Figure 5:
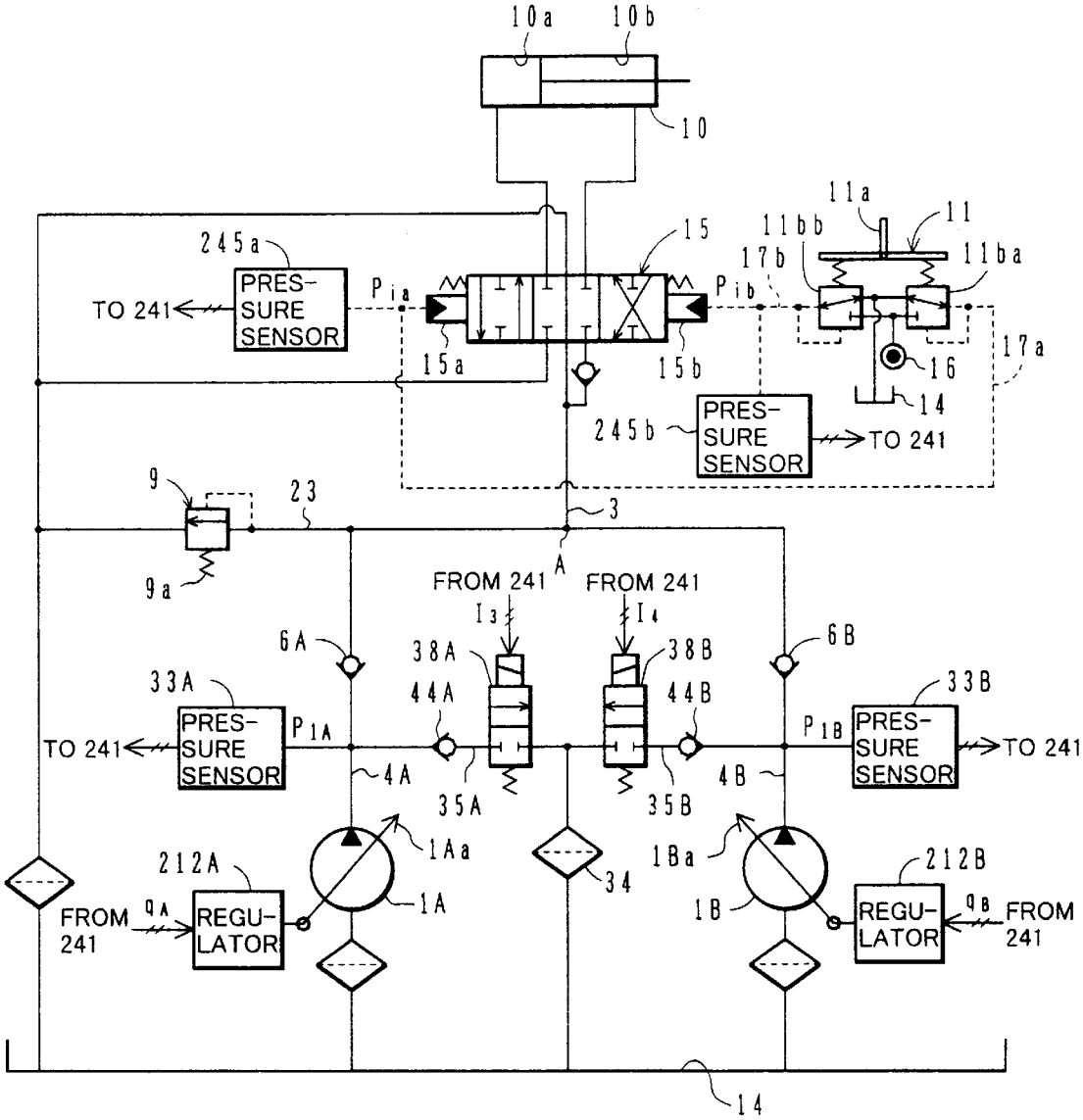
FIG. 5 is a hydraulic circuit diagram of a hydraulic drive system in which a pump failure alarm system according to a second embodiment of the present invention is employed.
Figure 5:
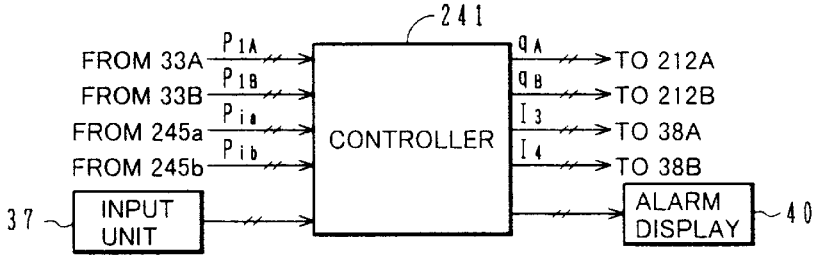

FIG. 5 is a hydraulic circuit diagram of a hydraulic drive system in which a pump failure alarm system according to the second embodiment is employed. Common components in FIG. 5 to those in FIG. 1 representing the first embodiment are denoted by the same reference numerals and description of those components is omitted unless necessary for understanding of this embodiment.

In FIG. 5, the hydraulic drive system is installed in hydraulic working machines such as hydraulic excavators similarly to the hydraulic drive system of FIG. 1. The hydraulic drive system of FIG. 5 differs from that of FIG. 1 in that, as pump control means for controlling the swash plates 1A*a*, 1B*a* of the first and second hydraulic pumps 1A, 1B, an electronically-operated regulators 212A, 212B for controlling the swash plates 1A*a*, 1B*a* in accordance with control signals applied from a controller 241 (as described later in detail) are provided instead of the hydraulically-operated regulators 12A, 12B.

Correspondingly, the solenoid switching valves 42A, 42B shown in FIG. 1 are omitted, while pressure sensors 245*a*, 245*b* for detecting pilot pressures Pia and Pib generated from a control lever unit 11, respectively, and outputting corresponding signals to the controller 241 are newly provided.

Figure 6:
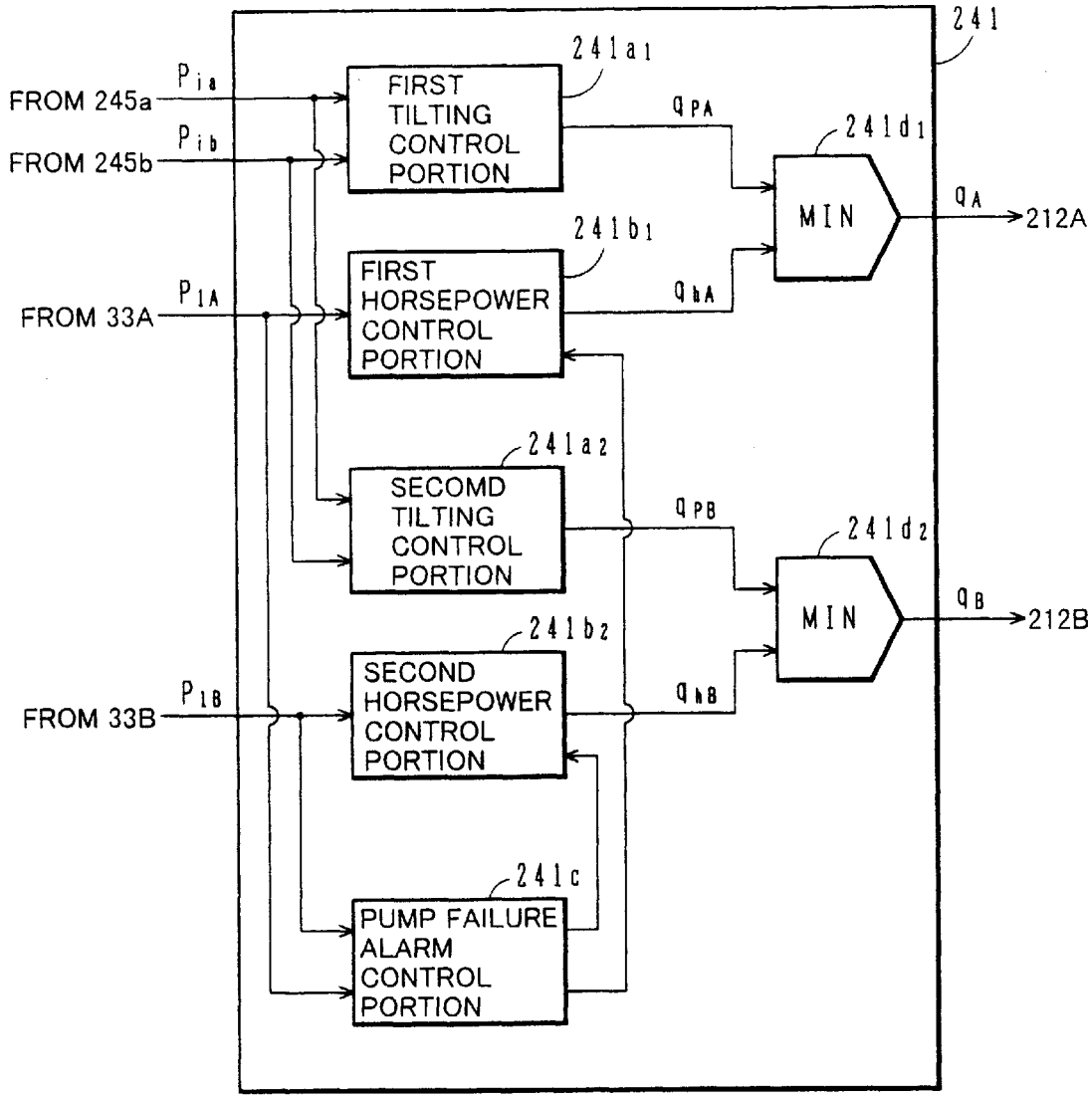
FIG. 6 is a block diagram showing detailed functions of a controller shown in FIG. 5.

The regulators 212A, 212B control respective tilting angles of the swash plates 1A*a*, 1B*a* of the first and second hydraulic pumps 1A, 1B in accordance with target displacements qA, qB, which are outputted from the controller 241, thereby controlling the displacements of the first and second hydraulic pumps 1A, 1B. FIG. 6 shows functions of the controller 241.

In FIG. 6, the controller 241 comprises first and second tilting control portions 241*a*1, 241*a*2 for calculating respectively target displacements qpA, qpB, which are used in ordinary tilting control, depending on the pilot pressures Pia, Pib generated from the control lever unit 11; first and second horsepower control portions 241*b*1, 241*b*2 for calculating, based on delivery pressures P1A, P1B of the first and second hydraulic pumps 1A, 1B, target displacements qhA, qhB in horsepower control at which the total input horsepower of the hydraulic pumps 1A, 1B is held not larger than the output horsepower of a prime mover; a pump failure alarm control portion 241*c* for causing an alarm an alarm display unit 40 to indicate an alarm and limiting the target displacements qhA, qhB calculated in the first and second horsepower control portions 241*b*1, 241*b*2 when any of the first and second hydraulic pumps 1A, 1B has failed; and first and second minimum value selecting portions (MIN) 241*d*1, 241*d*2 each having a minimum value selecting function.

Figure 7:
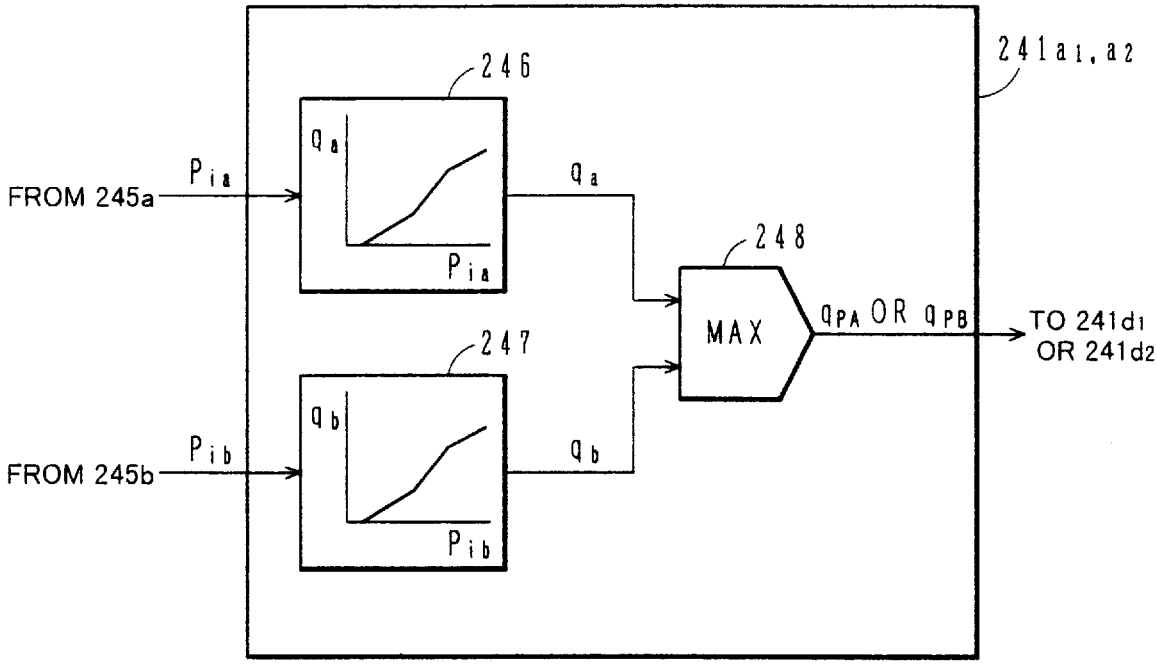
FIG. 7 is a block diagram showing detailed functions of a tilting control portion in the controller shown in FIG. 6.

The first and second tilting control portions 241*a*1, 241*a*2 have detailed functions shown in FIG. 7. Each tilting control portion 241*a*1, 241*a*2 comprises calculating portions 246, 247 and a maximum value selecting portion (MAX) 248. Target displacements qa, qb depending on the pilot pressures Pia, Pib are calculated respectively by the calculating portions 246, 247 based on tables preset therein as shown, and a maximum value of qa and qb is selected by the maximum value selecting portion 248. The selected value is outputted, as the target displacement qpA or qpB in the ordinary tilting control, to the minimum value selecting portion 241*d*1 or 241*d*2.

Figure 8:
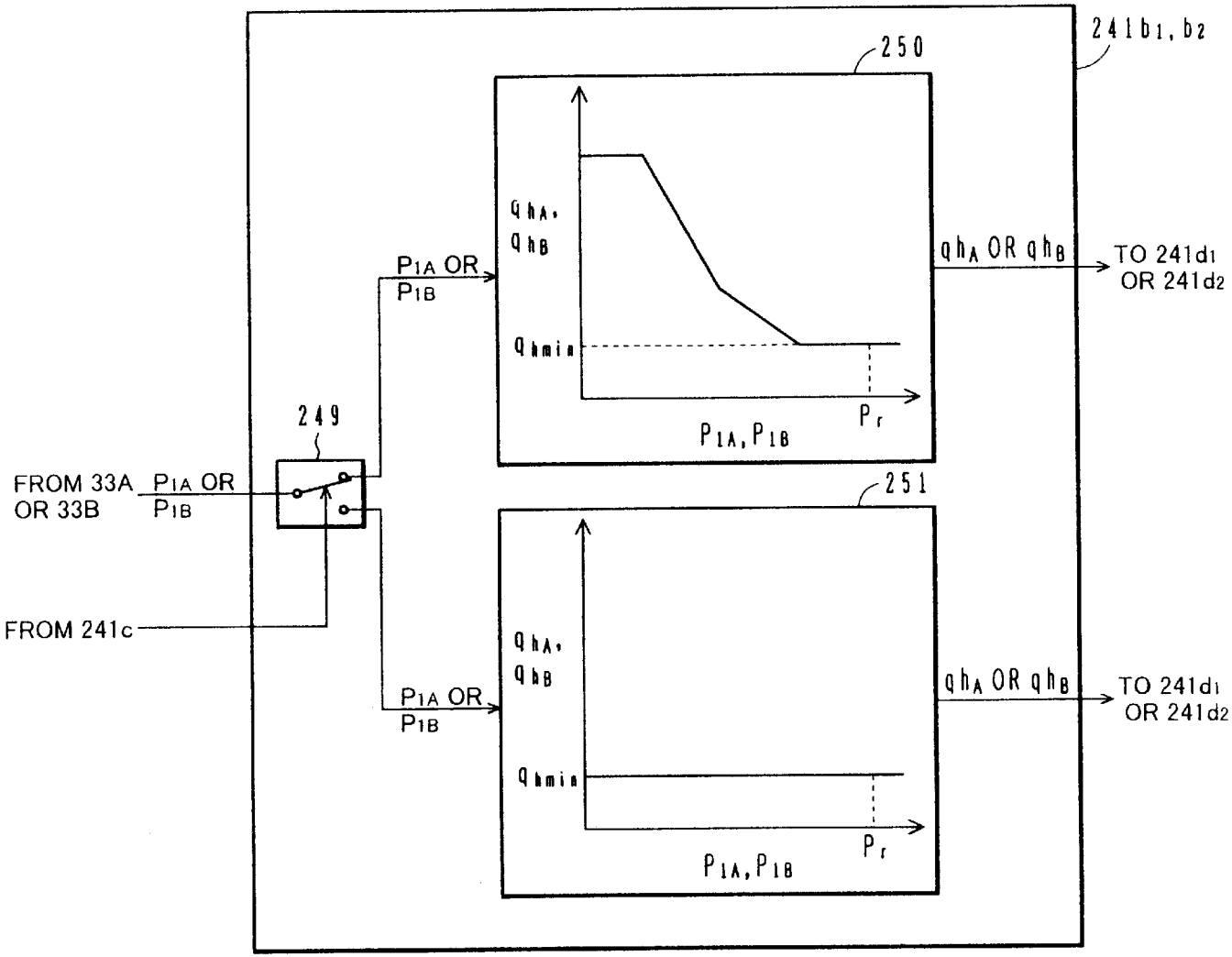
FIG. 8 is a block diagram showing detailed functions of a horsepower control portion in the controller shown in FIG. 6.

The first and second horsepower control portions 241*b*1, 241*b*2 have detailed functions shown in FIG. 8. Each horsepower control portion 241*b*1, 241*b*2 comprises a switch portion 249 and calculating portions 250, 251. The pump delivery pressure P1A or P1B detected by a pressure sensor 33A or 33B is inputted to the switch portion 249 and is then selectively applied to the calculating portion 250 or 251 in accordance with a control signal from the pump failure alarm control portion 241*c* described later in detail. The target displacement qhA or qhB in the horsepower control depending on the pump delivery pressure P1A or P1B is calculated by each of the calculating portions 250, 251 based on tables preset therein as shown, and is then outputted to the minimum value selecting portion 241*d*1 or 241*d*2.

As seen from the tables shown in FIG. 8, a function preset in the calculating portion 250 is selected so as to perform the ordinary horsepower control. Specifically, as the delivery pressure P1A, P1B rises, a maximum value of the target displacement qhA, qhB of the first or second hydraulic pump 1A, 1B is limited to a smaller value, and the tilting angle of swash plate 1A*a*, 1B*a* of the first or second hydraulic pump 1A, 1B is controlled so that the total load of the first and second hydraulic pumps 1A, 1B does not exceed the horsepower of the prime mover.

On the other hand, a function preset in the calculating portion 251 is selected so that the target displacement qhA, qhB is always kept at a minimum value qhmin regardless of the value of the delivery pressure P1A, P1B of the first or second hydraulic pump 1A, 1B.

Detailed functions of the pump failure alarm control portion 241*c* will be described with reference to a flowchart shown in FIG. 9.

Figure 9:
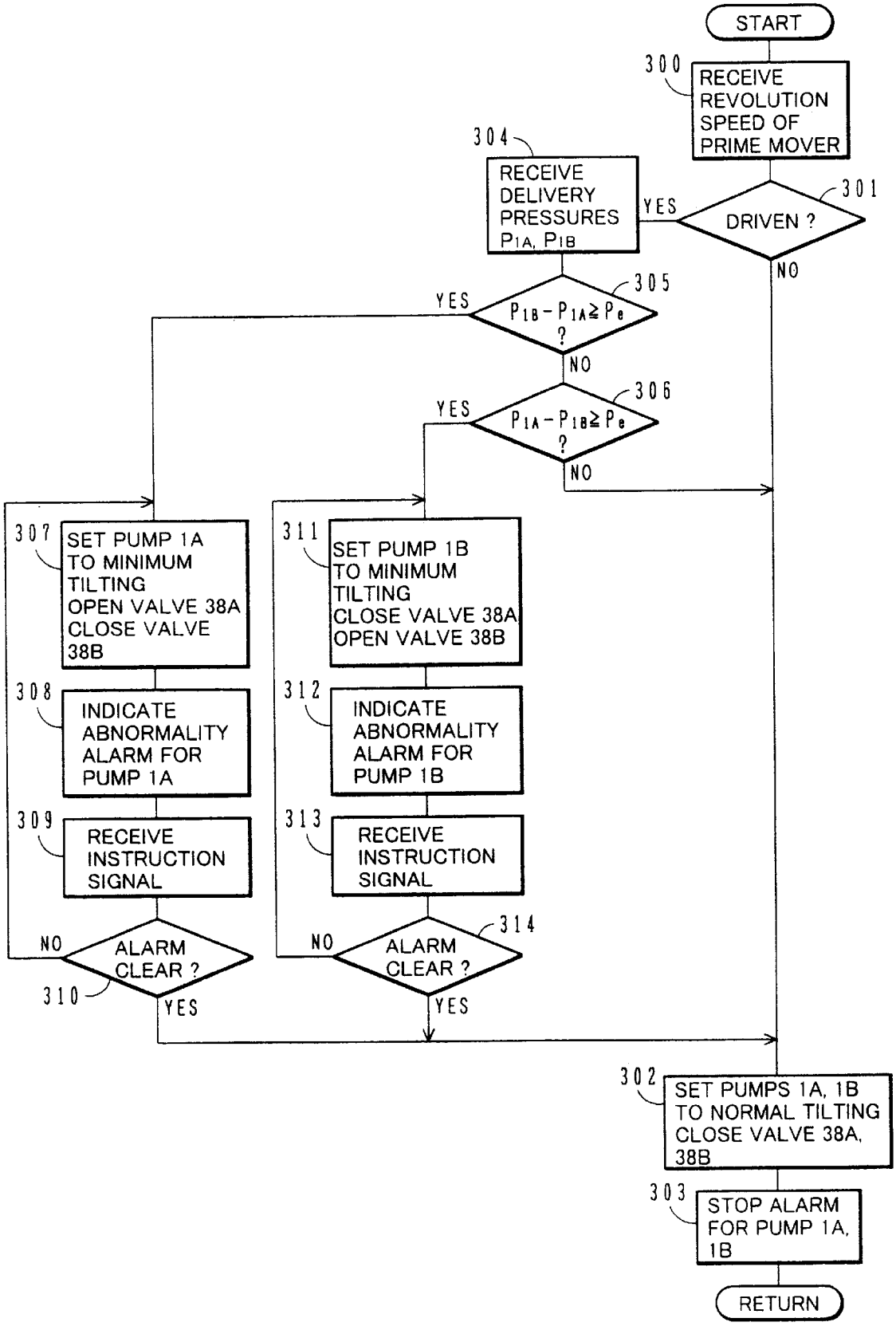
FIG. 9 is a flowchart showing detailed functions of a pump failure alarm control portion in the controller shown in FIG. 6.

Referring to FIG. 9, in step 300, the controller first receives a signal from the revolution speed sensor for detecting a revolution speed of the prime mover, and then determines in step 301 whether the first and second hydraulic pumps 1A, 1B are driven, in accordance with the signal received in step 300.

If the first and second hydraulic pumps 1A, 1B are not driven, the process flow goes to step 302 where the switch portions 249 of the horsepower control portions 241*b*1, 241*b*2 are changed over to be connected to the calculating portions 250 (on the upper side in FIG. 8) and the target displacements qhA, qhB in the ordinary tilting control are outputted to the minimum value selecting portions 241*d*1, 241*d*2 so that the final target displacements qA, qB in the ordinary tilting control and horsepower control are outputted to the regulators 212A, 212B. At the same time, driving signals I3, I4 applied to the solenoid switching valves 38A, 38B are turned off for shifting them to the closed positions, thereby cutting off the bypass lines 35A, 35B. After that, in step 303, the controller outputs a control signal for stopping any alarm to the alarm display unit 40, followed by returning to the start.

On the other hand, if it is determined in step 301 that the first and second hydraulic pumps 1A, 1B are driven, the process flow goes to step 304 where the controller receives the delivery pressures P1A, P1B of the first and second hydraulic pumps 1A, 1B from the pressure sensors 33A, 33B.

Then, in step 305 and step 306, the controller determines in accordance with the delivery pressures P1A, P1B, which were received in step 304, whether differences P1B−P1A and P1A−P1B between the delivery pressures P1A, P1B is not less than a predetermined value Pe. If P1B−P1A <Pe and P1A−P1B<Pe hold, the determinations in steps 305 and 306 are both not satisfied, and therefore the process flow goes to step 302.

If P1B−P1A≧Pe is satisfied in step 305, the controller determines that any failure has occurred in the first hydraulic pump 1A, followed by going to step 307. In step 307, the switch portion 249 of the horsepower control portion 241*b*1 is changed over to be connected to the calculating portion 251 (on the lower side in FIG. 8) and the target displacement qpA=qhmin is outputted to the minimum value selecting portion 241*d*1 so that the final target displacement qA=qhmin is outputted to the regulator 212A. The tilting angle of the swash plate 1A*a* of the first hydraulic pump 1A is thus minimized.

Incidentally, since the horsepower control portion 241*b*2 outputs the target displacement qhB in the ordinary horsepower control, the final target displacement qB in the ordinary tilting control and horsepower control is outputted to the regulator 212B.

Also, in step 307, the driving signal I3 applied to the solenoid switching valve 38A is turned on for shifting it to the open position. The bypass line 35A is thereby made open thoroughly so that the hydraulic fluid from the first hydraulic pump 1A is introduced to the hydraulic reservoir 14. The driving signal I4 applied to the solenoid switching valve 38B associated with the second hydraulic pump 1B is kept turned off, and the bypass line 35B is maintained in a cutoff state.

Subsequently, the process flow goes to step 308 where the controller indicates an alarm in the display portion of the alarm display unit 40 in correspondence to the first hydraulic pump 1A, whereby the operator is alarmed for the fact that a failure has occurred in the first hydraulic pump 1A, followed by going to step 309. In step 309, the controller receives an instruction signal from the input unit 37. The process flow then goes to step 310 where the controller determines whether the operator has instructed clear of the alarm. If the alarm clear instruction is not yet inputted, the controller returns to step 307 to repeat the processing described above. If the alarm clear instruction is inputted by the operator, the controller goes to step 302 where the tilting of the first hydraulic pump 1A is returned to the normal condition, causing both the regulators 212A, 212B to perform the ordinary tilting control and horsepower control while the bypass lines 35A, 35B are cut off.

On the other hand, if P1A−P1B≧Pe is satisfied in step 306, the controller determines that any failure has occurred in the second hydraulic pump 1B, followed by going to step 311.

In step 311, the switch portion 249 of the horsepower control portion 241*b*2 is changed over to be connected to the calculating portion 251 so that the tilting angle of the swash plate 1B*a* of the second hydraulic pump 1B is minimized. The tilting of the swash plate 1A*a* of the first hydraulic pump 1A is controlled under the ordinary tilting control and horsepower control. Further, the driving signal I4 applied to the solenoid switching valve 38B is turned on for shifting it to the open position. The bypass line 35B is thereby made open thoroughly so that the hydraulic fluid from the second hydraulic pump 1B is introduced to the hydraulic reservoir 14. The driving signal I3 applied to the solenoid switching valve 38A associated with the first hydraulic pump 1A is kept turned off, and the bypass line 35A is maintained in a cutoff state.

Subsequently, the process flow goes to step 312 where the controller indicates an alarm in the display portion of the alarm display unit 40 in correspondence to the second hydraulic pump 1B, whereby the operator is alarmed for the fact that a failure has occurred in the second hydraulic pump 1B. In step 313, the controller receives an instruction signal from the input unit 37. The process flow then goes to step 314 where the controller determines whether the operator has instructed clear of the alarm. If the alarm clear instruction is not yet inputted, the controller returns to step 311 to repeat the processing described above. If the alarm clear instruction is inputted by the operator, the controller goes to step 302 where the regulators 212A, 212B are set to perform the ordinary tilting control and horsepower control while the bypass lines 35A, 35B are cut off.

The remaining construction is substantially the same as in the first embodiment.

In the construction described above, the pump failure alarm control portion 241*c* constitutes control means for controlling the opening/closing operations of the opening/closing means and the alarming operation of the alarm means in accordance with the results detected by the pressure detecting means.

Also, the step 301 executed by the controller 241 constitutes second determining means for determining in accordance with the result detected by the drive detecting means whether at least two of a plurality of hydraulic pumps are driven. The steps 305 and 306 constitute first determining means for determining whether the delivery pressure of one of the plurality of hydraulic pumps is lower than the delivery pressure of another hydraulic pump by a predetermined value or more.

Further, the steps 307, 311 and 302 constitute opening/closing control means for opening the opening/closing means in a bypass line connected to a delivery line of the one hydraulic pump and closing the opening/closing means in bypass lines connected to delivery lines of the other hydraulic pumps in a first case where the determination made by the first determining means is satisfied, and for closing all the opening/closing means in a second case where the determination made by the first determining means is not satisfied. The steps 308, 312 and 303 constitute alarm control means for causing the alarm means to give an alarm in correspondence to the one hydraulic pump in the first case, and not causing the alarm means to give any alarm in the second case. The steps 307 and 311 also constitute flow rate limit control means for controlling the associated pump control means and limiting the delivery rate of the one hydraulic pump in the first case.

According to this second embodiment, as with the first embodiment, the operator can surely recognize and specify the failed hydraulic pump and can immediately take a maintenance action such as replacement of parts of the failed hydraulic pump. Consequently, suspension of the work to be performed by using a hydraulic excavator is minimized, and a reduction in the availability factor of the hydraulic excavator can be avoided.

Furthermore, since the regulator 212A (or 212B) associated with the one failed pump is set to the target displacement qA (or qB)=qhmin to minimize the pump delivery rate, the flow rate of the hydraulic fluid introduced from the failed hydraulic pump to the hydraulic reservoir 14 can be minimized similarly to the first embodiment. As a result, the capacities of the bypass lines 35A, 35B, the solenoid switching valves 38A, 38B, etc. can be set to relatively small values in the design stage; hence the costs of these parts can be reduced.

In the above second embodiment, if any hydraulic pump 1 is failed, the delivery rate of the failed hydraulic pump is minimized by limiting the target displacement in the horsepower control. However, the method for minimizing the delivery rate of the failed hydraulic pump is not limited to the illustrated one, but it may be implemented by limiting the target displacement in the ordinary tilting control in any other suitable way as with the first embodiment. Similar advantages can also be obtained with such a modification.

While the first and second embodiments have been described in connection with the case of applying the present invention to a hydraulic excavator as one example of hydraulic working machines, the present invention is not limited to the illustrated embodiments. It is needless to say that the present invention can also be applied to other construction machines, such as cranes, or other hydraulic working machines than construction machines.

Further, while in the first and second embodiments the so-called positive control method is employed in the regulators 12A, 12B; 212A, 212B to perform the ordinary tilting control depending on the input amount from the control lever 11*a* of the control lever unit 11, the regulator control scheme is not limited to the positive control method. The so-called negative control method may be of course employed instead. Similar advantages can also be obtained with such a modification.

Thus, according to the present invention, since the hydraulic fluid from one failed hydraulic pump can be isolated from the hydraulic fluid from one or more other hydraulic pumps and only the hydraulic fluid from the other hydraulic pumps can be introduced to the hydraulic cylinder through the common delivery line, it is possible to avoid an adverse effect of the pump failure from spreading to the entire hydraulic circuit, which may be possibly caused by, for example, any fragments of the failed hydraulic pump if they should intrude into the common delivery line and the hydraulic cylinder.

Also, since the operator can surely recognize and specify that the one hydraulic pump has failed, the operator can immediately take a maintenance action such as replacement of parts of the failed hydraulic pump. As a result, suspension of the work to be performed by using a hydraulic working machine is minimized, and a reduction in the availability factor of the machine can be avoided.

What is claimed is:

1. A pump failure alarm system installed in a hydraulic working machine comprising a plurality of hydraulic pumps driven by at least one prime mover, a plurality of delivery lines introducing respective flows of a hydraulic fluid delivered from said plurality of hydraulic pumps and joining with one another into one common line on the downstream side, a plurality of check valves provided respectively in said plurality of delivery lines upstream of a point where said plurality of delivery lines join with one another, at least one hydraulic actuator driven by the hydraulic fluid introduced through said common line, and a hydraulic reservoir, said pump failure alarm system comprising:

a plurality of pressure detecting means for detecting respective delivery pressures of said plurality of hydraulic pumps, a plurality of bypass lines having one ends connected respectively to said plurality of delivery lines at points upstream of said check valves and the other ends connected to said hydraulic reservoir, a plurality of opening/closing means disposed respectively in said plurality of bypass lines for opening and closing the associated bypass lines, alarm means for giving an alarm to an operator in correspondence to each of the plurality of hydraulic pumps, and control means for controlling the opening/closing operations of said opening/closing means and the alarming operation of said alarm means in accordance with the results detected by said pressure detecting means.

2. A pump failure alarm system for a hydraulic working machine according to claim 1, wherein said control means comprises first determining means for determining whether the delivery pressure of one of said plurality of hydraulic pumps is lower than the delivery pressures of the other hydraulic pumps by a predetermined value or more, opening/closing control means for opening the opening/closing means in the bypass line connected to the delivery line of said one hydraulic pump and closing the other opening/closing means in a first case where the determination made by said first determining means is satisfied, and for closing all the opening/closing means in a second case where the determination made by said first determining means is not satisfied, and alarm control means for causing said alarm means to give an alarm in correspondence to said one hydraulic pump in said first case, and not causing said alarm means to give any alarm in said second case.

3. A pump failure alarm system for a hydraulic working machine according to claim 2, wherein said alarm means includes a plurality of display means for indicating alarms separately in correspondence to said hydraulic pumps, and said alarm control means causes the display means associated with said one hydraulic pump to indicate an alarm in said first case.

4. A pump failure alarm system for a hydraulic working machine according to claim 2, wherein said plurality of hydraulic pumps are variable displacement pumps whose displacements are controlled respectively by a plurality of pump control means, and said control means includes flow rate limit control means for controlling the pump control means associated with the one hydraulic pump and limiting a delivery rate of said one hydraulic pump in said first case.

5. A pump failure alarm system for a hydraulic working machine according to claim 2, further comprising drive detecting means for detecting whether said hydraulic pumps are driven, wherein said control means comprises second determining means for determining whether at least two of said plurality of hydraulic pumps are driven, and wherein when the determination made by said second determining means is not satisfied, said opening/closing control means closes all the opening/closing means regardless of the results detected by said pressure detecting means and said alarm control means does not cause said alarm means to give any alarm to the operator regardless of the results detected by said pressure detecting means.

6. A pump failure alarm system for a hydraulic working machine according to claim 1, further comprising drive detecting means for detecting whether said hydraulic pumps are driven, wherein when at least one of said hydraulic pumps is determined to be not driven in accordance with the result detected by said drive detecting means, said control means excludes the opening/closing means and the alarm means, which are associated with the hydraulic pump not being driven, from objects to be controlled.

* * * * *